United States Patent [19]

Whitson

[11] Patent Number: 4,825,258

[45] Date of Patent: Apr. 25, 1989

[54] DEVICE FOR BORE ALIGNMENT OF GUN SIGHTS

[76] Inventor: John M. Whitson, 306 Spruce, Woodward, Okla. 73801

[21] Appl. No.: 140,552

[22] Filed: Jan. 4, 1988

[51] Int. Cl.[4] ..... G01B 11/26

[52] U.S. Cl. ..... 356/153; 33/234; 33/286

[58] Field of Search ..... 356/138, 153; 33/234, 33/286; 279/2 R

[56] References Cited

U.S. PATENT DOCUMENTS

| | | | |
|---|---|---|---|
| 1,295,075 | 2/1919 | Sheppard . | |
| 1,548,730 | 8/1925 | Mirfield | 279/2 R |
| 1,564,432 | 12/1925 | Marcuse et al. . | |
| 3,112,567 | 12/1963 | Flanagan | 33/74 |
| 3,612,949 | 10/1971 | Becraft et al. | 356/153 |
| 3,711,204 | 1/1973 | Steck, III | 356/153 |
| 3,744,133 | 7/1973 | Fukushima et al. | 33/234 |
| 3,782,832 | 1/1974 | Hacskaylo | 356/153 |
| 3,787,693 | 1/1974 | Stone | 250/330 |
| 3,908,282 | 9/1975 | Steffan | 33/234 |
| 4,057,905 | 11/1977 | Piaja | 33/234 |
| 4,090,305 | 5/1978 | Cassidy | 33/234 |
| 4,095,347 | 6/1978 | Steffan | 33/234 |
| 4,168,429 | 9/1979 | Lough | 250/330 |
| 4,530,162 | 7/1985 | Forrest et al. | 33/228 |
| 4,750,269 | 6/1988 | Townsend et al. | 33/234 |

*Primary Examiner*—F. L. Evans

*Attorney, Agent, or Firm*—Laney, Dougherty, Hessin & Beavers

[57] ABSTRACT

An apparatus to enable accurate sight adjustment of rifles consisting of a mounting assembly formed as a body of revolution and having a head portion, a mandrel portion and a cylinder portion including an expansion tube. A suitable light spot generating device is mounted in axial alignment with the mounting assembly head portion and the mandrel and cylinder portions may be inserted in the muzzle end of the gunbore and secured in axial position so that the light beam projected to a distant target may provide sighting reference for an associated scope of mechanical sight.

11 Claims, 2 Drawing Sheets

DEVICE FOR BORE ALIGNMENT OF GUN SIGHTS

BACKGROUND OF THE INVENTION

1. Field of the Invention

The invention relates generally to gun sight alignment apparatus and, more particularly, but not by way of limitation, it relates to an improved sighting device utilizing a bore-aligned light beam for calibration adjustment of mechanical and microscopic gun sights.

2. Description of the Prior Art

The prior art includes numerous types of sight calibration device for aligning a gun sight in true relationship with the gun bore. Early procedures for bore alignment included various means for aligning the bore axis at or near the end of the muzzle with the sight axis, and with additional means for allowance of bullet drop per distance. Later attempts at sighting in of rifles included various light projection devices which enabled somewhat more precise alignment. U.S. Pat. Nos. 4,168,429 and 3,787,693 were directed to infrared bore scope devices which enabled alignment in the field without the necessity for firing a shot. The '693 patent actually uses a light emitting device that is held in alignment with the bore axis for target reflection and subsequent viewing by the operator having a night viewing scope on his head. This device requires alignment of a pulsing and a continuous beam in order to align the rifle sight.

U.S. Pat. No. 3,711,204 teaches another type of device which is inserted in the muzzle end of the gun bore to prove alignment. This device utilizes a reverting optical means for use in initial centering of the device on the axis of the gun barrel and, thereafter, the device is tightly secured for subsequent viewing and alignment by means of the rifle sight. U.S. Pat. No. 4,530,162 teaches a different approach wherein a light source is employed to direct a beam of light from the breech through the barrel bore to a distant target, whereupon the optical sight or scope may be adjusted relative to the spot. U.S. Pat. No. 3,782,832 teaches a similar type of device wherein a light emitting source is formed in the general shape of a cartridge and it is inserted in the breech of the weapon to provide a narrow bore sight light along the true bore axis of the weapon. The weapon also carries a scope-like aiming light which may be aligned with the bore axis light to assure correct sighting for nighttime firing. Still other patents of less pertinence are noted in the Information Disclosure Statement submitted herewith.

SUMMARY OF THE INVENTION

The present invention relates to an improved type of gun sight alignment device using a compact laser assembly and bore insert mechanism to generate a light spot that is projectable for a considerable distance in true alignment with the gun bore axis. The gun sight or scope can then be adjusted with allowance for bullet drop per distance relative to the projected spot.

Therefore, it is an object of the present invention to provide an improved device for sighting in of a rifle.

It is another object to provide a gun sighting device that may be safely employed in congested areas and even sporting goods and other retail outlets.

It is also an object of the present invention to provide an improved type of laser sighting device that is capable of projecting a beam of light along a gun barrel bore axis.

Finally, it is an object of the present invention to provide a laser bore sight device that is quickly employed and highly reliable for bore sight check in the field.

Other objects and advantanges of the invention will be evident from the following detailed description when read in conjunction with the accompanying drawings which illustrate the invention.

DETAILED DESCRIPTION OF THE INVENTION

Figure 1:
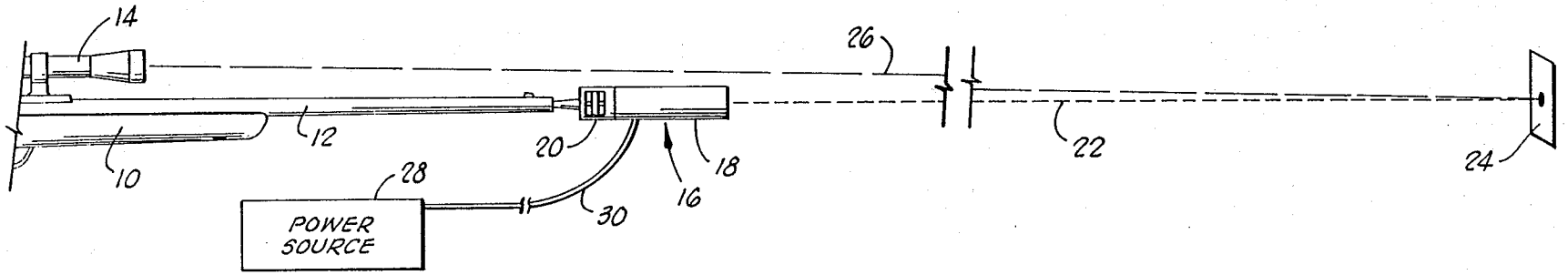
FIG. 1 is an idealized side view of a rifle with bore sight device assembled in association with a target device.

Referring to FIG. 1, a rifle 10 having barrel 12 and microscopic sight or scope 14 mounted thereon is shown with a bore alignment light source 16 mounted in the bore muzzle end. In this case, the light source consists of a laser 18 secured axially in a bore mounting assembly 20 and projecting a light beam 22 towards a target 24. The scope 14 may be adjustably set to view target 24 along optical axis 26.

The light source 18 may be other than a laser source provided sufficient intensity can be developed, but in the case of a laser a power source 28, either A-C or D-C voltage, supplies the requisite power input via connecting cable 30. The requirements of laser 18 and power source 28 are relatively small such that a suitable power source is available that may be energized from such as an automobile cigarette lighter 12 volt supply. A suitable laser for use in the sighting system 16 may be such as a helium-neon laser of the low-power type as is commercially available for visual alignment applications. Such laser assemblies with power pack are available from Jodon Inc. of Ann Arbor, Mich.

Figure 2:
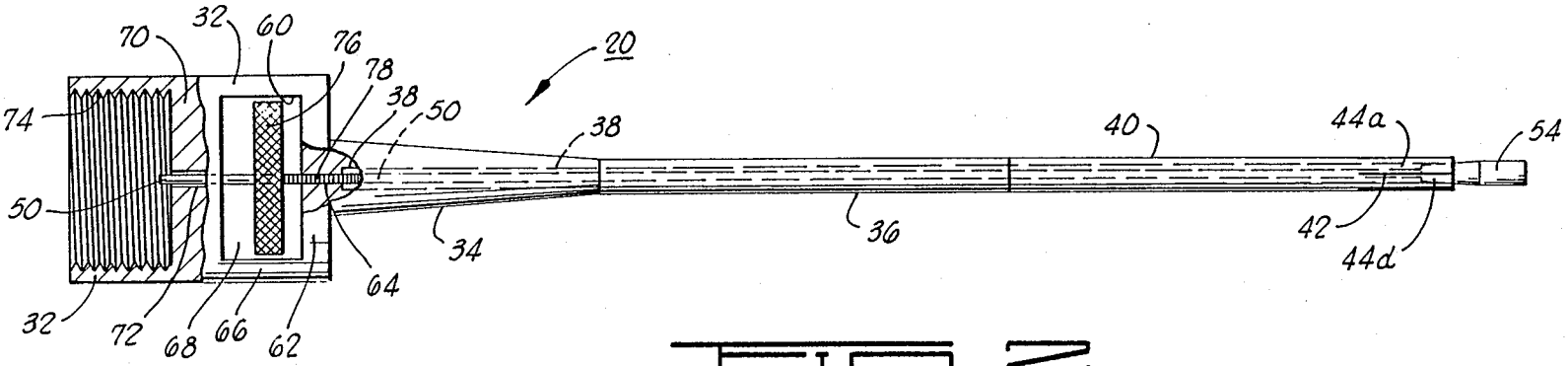
FIG. 2 is a view in side elevation with parts shown in section of the bore alignment mechanism of the present invention.
Figure 3:
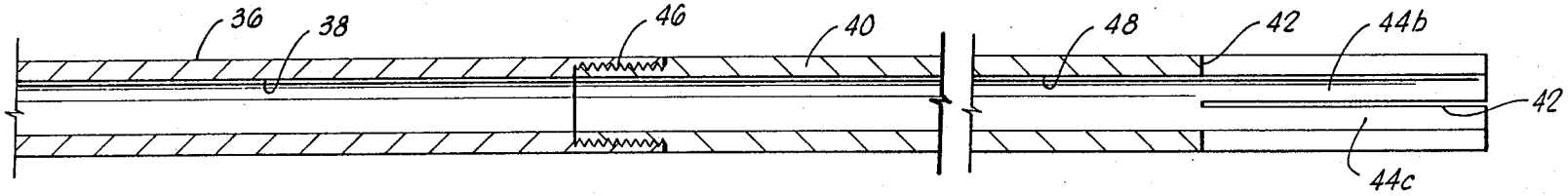
FIG. 3 is an enlarged side view in vertical section of a portion of the insert mechanism of FIG. 3.

Referring to FIG. 2, the mounting assembly 20 consists of an elongated member having a mounting head 32 that extends into a mandrel portion 34 which extends still further into a uniform diameter cylinder portion 36. An expansion tube 40 is then threadedly secured on tube portion 36 as shown in FIG. 3. The expansion tube 40 is formed preferably of brass or other metal substance significantly softer than the gun barrel material, and expansion tube 40 also provides a continuation of the axial bore 38. The expansion tube 40 has the distal end formed with a quadrature array of longitudinal slits 42 to define expandable tines **44*a*–44*d***.

Figure 4:
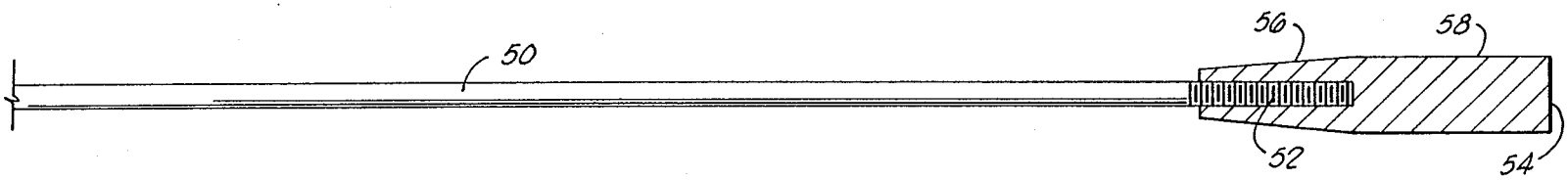
FIG. 4 is an enlarged side view in elevation of a portion of the actuating rod which is disposed axially within the actuating mechanism of FIG. 2.

The expansion tube 40 secures in axial alignment with cylinder portion 36 by means of threads 46 and the axial bore 48 is continuous with axial bore 38 of cylinder portion 36. As shown in FIG. 4, a control rod 50 of suitable diameter to be slidingly received in axial bore 38 and 48 is formed with threads 52 for receiving mandrel nut 54 in secure engagement thereon. Mandrel nut 54 is formed as a body of revolution having a rise portion 56 inclined at an angle of about 20° to the axis of rod 50 and a land portion 58 of cylindrical form. Thus, as control rod 50 is drawn outward through axial bores 38 and 48, the mandrel nut 56 tends to diametricaly expand the tines 44*a–d* into secure abutment with the gun bore cylindrical wall, as will be further described.

Referring again to FIG. 2, the mounting assembly 20 may be unitarily formed to extend from mandrel portion 34 into the cylindrical head portion 32 with an access cutaway 60 formed for control purposes. Thus, the head portion 32 includes a rear wall 62 having an axial threaded bore 64 and a cylindrical side wall 66. Most of side wall 66 is removed by the cut out portion 60 to allow access into a void 68. The void 68 is enclosed by a middle wall 70 having a central bore 72 for receiving axial rod 50 slidably therethrough. The forward portion of head portion 32 is formed with a wide diameter axial bore for formation of threads 74 which provide for secure fastening of the laser or other light source element 18.

The control rod 50 extends axially throughout the length of mounting assembly 20 (FIG. 2) as the mandrel nut 54 is secured on the distal end and functions to reciprocate and expand and contract the diameter of tines 44*a–d*. A knurled thumb nut 76 is suitably secured as by braising or otherwise bonding to the forward end of control rod 50 as it is disposed for movement in bore 72 of forward wall 70. The control rod 50 has a short expanse of threads 78 formed thereon in position to engage within threaded bore 64 such that rotation of the thumb nut 76 will reciprocate the control rod 50 longitudinally to move mandrel nut 54.

The mounting assembly 20 is formed so that it may utilize a plurality of different expansion tubes 40 with an associated mandrel nut 54 in order to accommodate usage with the full range of rifle bore diameters, i.e., from .22 caliber up to .50 caliber. It is presently contemplated that three expansion tubes 40 of varying diameter along with a required three mandrel nuts 54 can be utilized to cover the entire diameter range.

Figure 5:
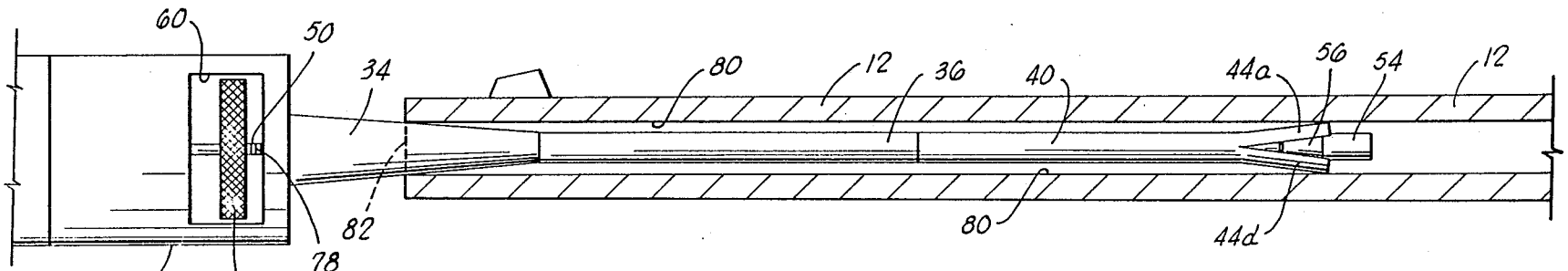
FIG. 5 is a view in side elevation with parts shown in section of the bore sight alignment device as positioned in axial alignment in a gun bore.

In operation, the user connects the assembly 16 to a suitable power source 28. At present, provision has been made for the laser power pack to be energized from such as a twelve volt automotive cigarette lighter connection and the device can be readily set up and used in the field. The mounting assembly 20 is then inserted into the muzzle end of the gun bore 80 (FIG. 5) which is an axial cylinder of constant diameter. The gun barrel 12 will progress up to a certain diameter point on the mandrel portion 34, depending upon caliber, where it is firmly positioned as at peripheral point 82. The knurled thumb nut 76 is then rotated to rotate control rod 50 and threads 78 such that the mandrel nut 54 is drawn forward causing the conical surface 56 to spread tube tines 44*a–d* outward until they are in tight engagement around the inner wall of gun bore 80.

In this attitude, the assembly 16 is held firmly in the muzzle end of the rifle 10. It is held in alignment with the gun bore 80 by virtue of the fact that the supporting cylindrical contacts at mandrel portion 34 (point 82) and expansion tines 44*a–d* are sufficiently spaced to assure a very exacting axial alignment.

Sighting in of the scope 14 (FIG. 1) can then proceed as the target 24 is posted at a selected distance from the gun position. The target 24 is preferably a specialized type having phosphorescent colors and ring designations showing departure from axial center. The light spot projected along beam 22, e.g., a red light beam, is projected onto target 24 whereupon the scope 14 or mechanical gun sight can be adjusted to show true direction. With knowledge of the size of bullet and the distance from gun to target 24, allowance can be made for bullet drop per distance as such data may readily be calculated for all reasonable shot ranges and the sight 14 adjusted accordingly. It should be understood that a preferred form of laser assembly provides a collimated $\frac{1}{8}$ inch diameter output beam without the necessity for further collimator lens system. The beam spot expands about one inch per 100 feet and the proportionately enlarged spot is easily seen in proper dark conditions by scope to as much as one-half mile away.

The foregoing discloses a novel gun sight adjustment device wherein a light beam standard is positionable to be emitted directly from the end of the gun barrel bore in exact axial alignment. Thus, a light device is provided that may be energized to provide a projected light spot out to a considerable distance for imaging on a target at a point which would be the true, direct bullet position relative to the gun. It is only necessary then to image the projected spot in the scope or mechanical sight for the known target distance and thereafter make target distance variations adjustable in proportioning manner. A sighting adjustment constructed in accordance with the present invention is relatively economical while providing a quick, accessible sighting-in device that may be readily set up for use in the field with a minimum of time and trouble.

Changes may be made in combination and arrangements as heretofore set forth in the specification and shown in the drawings; it being understood that changes may be made in the embodiments disclosed without departing from the spirit and scope of the invention as defined in the following claims.

The embodiments of the invention in which an exclusive property or priviledge is claimed are as follows:

1. A device for alignment of gunsights with the respective gun barrel bore, comprising:

a mounting assembly consisting of an elongated body of revolution having an axial bore and being formed as an outer head portion extending into a conical mandrel portion to be firmly received into the gun bore, and further extending a cylinder portion with expansion tube toward the distal end of the gun bore, a portion of said head portion axial bore having threads formed therein;

a control rod with mandrel nut rotatably disposed through the axial bore of the mounting assembly with the mandrel nut distally adjacent said expansion tube, a portion of said control rod having threads formed thereon for mating engagement with the threads in said axial bore;

manually rotatable means accessible in said mounting assembly head portion for rotating said control rod and changing the relative thread positioning to move said mandrel nut and expand the expansion tube into firm engagement with the distal gun bore wall thereby to axially align the mounting assembly;

a light source secured in axial alignment to said mounting assembly outer head portion, said light source directly projecting a radiation beam in axial alignment with the axial bore of said mounting assembly; and target means disposed at a selected distance to intercept said radiation beam and provide indication for sighting and aligning the gunsight.

2. A device as set forth in claim 1 wherein:

said light source is a laser assembly.

3. A device as set forth in claim 1 wherein:

said light source is a helium-neon type laser assembly.

4. A device as set forth in claim 1 wherein said expansion tube comprises:

a tube having lesser outer diameter than said axial bore and an inner diameter to accomodate rotatable positioning of said control rod, the distal end of said tube being slotted to define a quadrature array of tines that are forcible outward into peripheral contact with the gun bore wall.

5. A device as set forth in claim 1 wherein:

said mandrel nut has a conical portion secured axially to said control rod and extends distally to terminate in an enlarged generally cylindrical surface.

6. A device as set forth in claim 4 wherein:

said mandrel nut has a conical portion secured axially to said control rod and extends distally to terminate in an enlarged generally cylindrical surface.

7. A device as set forth in claim 6 wherein:

said expansion tube is threadedly received in axial alignment on said mounting assembly cylinder portion, and said expansion tube is formed of relatively softer material than the gun barrel.

8. A device as set forth in claim 4 wherein:

a selected one of several expansion tubes of different diameter may be used in order to best grip within a range of gun barrel bore diameters.

9. A device as set forth in claim 7 wherein:

a selected one of several expansion tubes of different diameter may be used in order to best grip within a range of gun barrel bore diameters.

10. A device as set forth in claim 1 wherein said target means comprises:

a high visibility member that exhibits enhanced optical response to the particular light source radiation beam.

11. A device as set forth in claim 1 wherein said rotatable means comprises:

a knurled thumb nut secured on said control rod and accessible in said outer head portion of the mounting assembly.

* * * * *